US011510518B2

(12) United States Patent
Franz et al.

(10) Patent No.: US 11,510,518 B2
(45) Date of Patent: Nov. 29, 2022

(54) WINDOW SHELF ASSEMBLY

(71) Applicants: Dean Franz, Shrewsbury, PA (US); Lynne Franz, Shrewsbury, PA (US)

(72) Inventors: Dean Franz, Shrewsbury, PA (US); Lynne Franz, Shrewsbury, PA (US)

( * ) Notice: Subject to any disclaimer, the term of this patent is extended or adjusted under 35 U.S.C. 154(b) by 267 days.

(21) Appl. No.: 16/996,312

(22) Filed: Aug. 18, 2020

(65) Prior Publication Data

US 2022/0053961 A1 Feb. 24, 2022

(51) Int. Cl.

| | |
|---|---|
| ***F24F 1/027*** | (2019.01) |
| ***A47H 27/00*** | (2006.01) |
| ***E06B 7/28*** | (2006.01) |
| ***A47B 5/02*** | (2006.01) |

(52) U.S. Cl.

CPC ..... *A47H 27/00* (2013.01); *A47B 5/02* (2013.01); *E06B 7/28* (2013.01)

(58) Field of Classification Search

CPC .. A47H 27/00; A47B 5/02; E04G 5/00; E04G 23/00; E06B 7/28; F16M 13/022; A01K 1/0353; A47L 3/02; F24F 13/32; F24F 13/022; F24F 1/027; F24F 2221/20

USPC ..... 211/90.03; 248/208, 236, 674, 678, 302, 248/298.1, 301, 676, 175, 220.21, 226.11, 248/209

See application file for complete search history.

(56) References Cited

U.S. PATENT DOCUMENTS

| | | | | | |
|---|---|---|---|---|---|
| 98,605 | A * | 1/1870 | Loomis | A47L 3/02 | 182/61 |
| 133,962 | A * | 12/1872 | Balmforth | A47L 3/02 | 182/61 |
| 310,057 | A * | 12/1884 | Howe | A47L 3/02 | 297/464 |
| 353,768 | A * | 12/1886 | Trafton | A47L 3/02 | 182/62 |
| 430,971 | A * | 6/1890 | Reed | A47L 3/02 | 182/61 |
| 477,355 | A * | 6/1892 | Curtis et al. | A47H 27/00 | 211/88.03 |
| 534,686 | A * | 2/1895 | Falk | A47L 3/02 | 182/60 |
| 542,648 | A * | 7/1895 | Keirsted | A47L 3/02 | 297/352 |
| 798,683 | A * | 9/1905 | Ketteman | A47L 3/02 | 182/61 |
| 943,436 | A * | 12/1909 | Martens et al. | A47L 3/02 | 182/60 |
| 965,816 | A * | 7/1910 | Hill | E04G 5/06 | 211/195 |
| 1,004,426 | A * | 9/1911 | Hill | E04G 5/06 | 248/240.3 |
| 1,007,641 | A * | 10/1911 | Carr | A47L 3/02 | 182/62 |

(Continued)

*Primary Examiner* — Nkeisha Smith

(57) ABSTRACT

A window shelf assembly for displaying an object in on a window sill includes a first bracket that is positionable on a window sill. A plurality of bars is provided and each of the bars is coupled to the first bracket. A second bracket is provided and each of the bars is coupled thereto such that the second bracket is spaced from the first bracket. An arm is movably disposed on the second bracket. The arm abuts a wall in which the window is positioned for supporting the bars on a horizontal plane to define a support surface for displaying an object.

5 Claims, 5 Drawing Sheets

(56) References Cited

U.S. PATENT DOCUMENTS 1,125,051 A * 1/1915 Bonenberger et al. ... E04G 5/06 248/240.3
1,165,435 A * 12/1915 Mishel ..... A47L 3/02 182/60
1,209,839 A * 12/1916 Hokenson ..... A47L 3/02 182/61
1,224,127 A * 5/1917 Bartlett ..... A47B 96/061 182/62
1,572,646 A * 2/1926 Gamber ..... A47L 3/02 182/61
1,627,241 A 5/1927 Johnson
1,636,185 A * 7/1927 Goodwin ..... E04G 5/06 248/245
1,658,942 A * 2/1928 Renstrom ..... A47L 3/02 182/61
2,059,739 A * 11/1936 Ment ..... A47L 3/02 182/152
2,420,635 A * 5/1947 Workman ..... A47L 3/02 182/61
2,568,968 A * 9/1951 Perrin ..... E04G 3/18 248/236
2,717,139 A * 9/1955 Jewell ..... F24F 13/32 182/62
2,935,284 A * 5/1960 Reeves ..... F24F 13/32 248/208
3,010,534 A * 11/1961 Borke ..... E04G 3/18 182/58
3,273,843 A * 9/1966 Bell, Jr. ..... F24F 13/32 248/208
3,433,443 A 3/1969 Mangan
3,857,365 A * 12/1974 Mueller ..... A01K 1/035 119/28.5
4,869,451 A * 9/1989 Gordon ..... A47H 27/00 D30/118
5,125,517 A * 6/1992 Martinell ..... B62H 3/12 211/90.03
5,636,816 A * 6/1997 Burton ..... F24F 13/32 62/262
5,725,111 A * 3/1998 Choi ..... D06F 57/12 211/104
8,091,844 B1 * 1/2012 Bragg ..... F24F 13/32 248/220.21
8,533,955 B2 * 9/2013 Agnihotri ..... F16M 13/02 248/209
8,584,998 B1 * 11/2013 Peterson ..... F24F 13/32 182/62
9,163,854 B2 * 10/2015 Arbucci ..... A47F 3/02
9,303,895 B1 * 4/2016 Grant ..... F24F 13/32
9,447,916 B2 * 9/2016 Darby ..... F24F 13/32
10,295,221 B2 * 5/2019 Zhang ..... F16M 13/02
10,436,383 B1 10/2019 Darby
11,168,920 B1 * 11/2021 Leezer ..... F24F 13/32
11,339,993 B2 * 5/2022 Zhao ..... F24F 13/32
2006/0236896 A1 * 10/2006 Heroux ..... A01K 1/035 108/11
2008/0134430 A1 6/2008 Kirmon
2018/0023842 A1 * 1/2018 Gardikis, Sr. ..... F16M 13/02 248/674
2020/0036323 A1 * 1/2020 Simon ..... E06B 7/28
2021/0078118 A1 * 3/2021 Li ..... F24F 13/30
2021/0180828 A1 * 6/2021 Xing ..... F24F 13/32

* cited by examiner

WINDOW SHELF ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shelf devices and more particularly pertains to a new shelf device to support an object for display in a window.

(2) Description of Related Art Including Information Disclosed Under 37 CFR 1.97 and 1.98

The prior art relates to shelf devices including a detachable shelf bracket for engaging a window sill. The prior art discloses a variety of temporary shelves that are attachable to a window sill and that each includes a support arm. The prior art discloses a shelf that mountable to a window sill which includes a plurality of bars that defines a support surface for the shelf. The prior art discloses a support bracket that mounts to a window for supporting an object on an exterior wall of a building.

BRIEF SUMMARY OF THE INVENTION

An embodiment of the disclosure meets the needs presented above by generally comprising a first bracket that is positionable on a window sill. A plurality of bars is provided and each of the bars is coupled to the first bracket. A second bracket is provided and each of the bars is coupled thereto such that the second bracket is spaced from the first bracket. An arm is movably disposed on the second bracket. The arm abuts a wall in which the window is positioned for supporting the bars on a horizontal plane to define a support surface for displaying an object.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
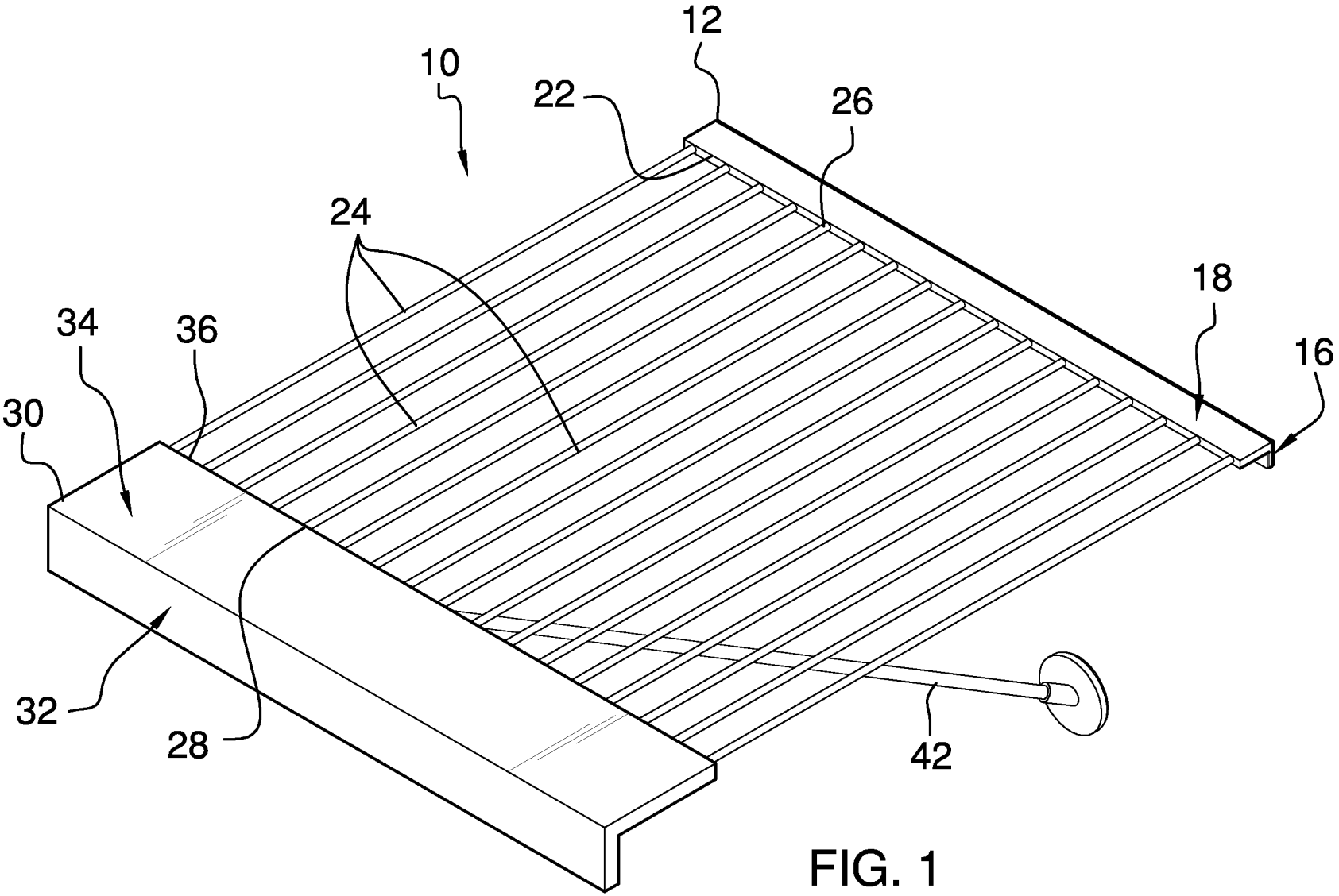
FIG. 1 is a top perspective view of a window shelf assembly according to an embodiment of the disclosure.
Figure 2:
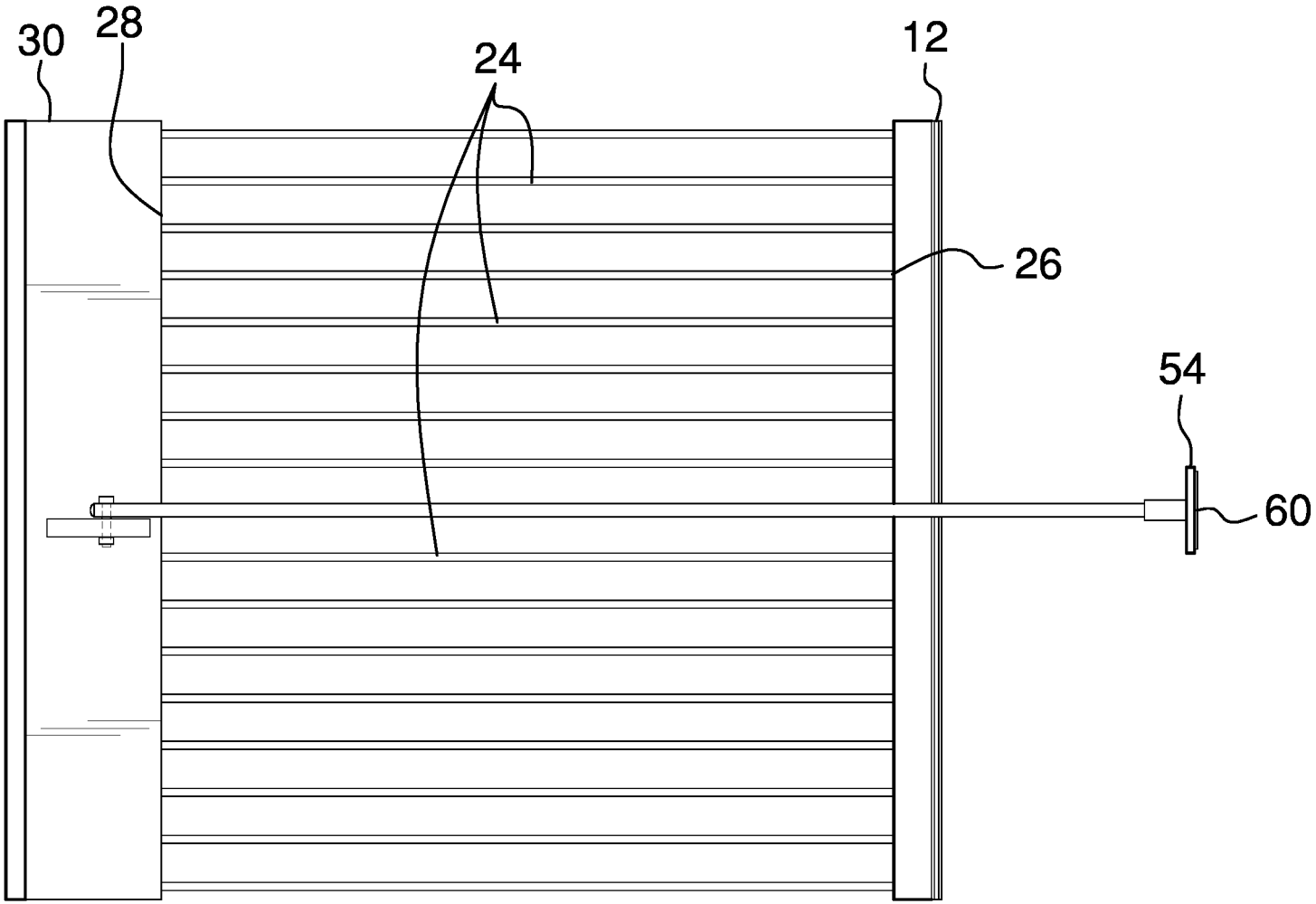
FIG. 2 is a bottom view of an embodiment of the disclosure.
Figure 3:
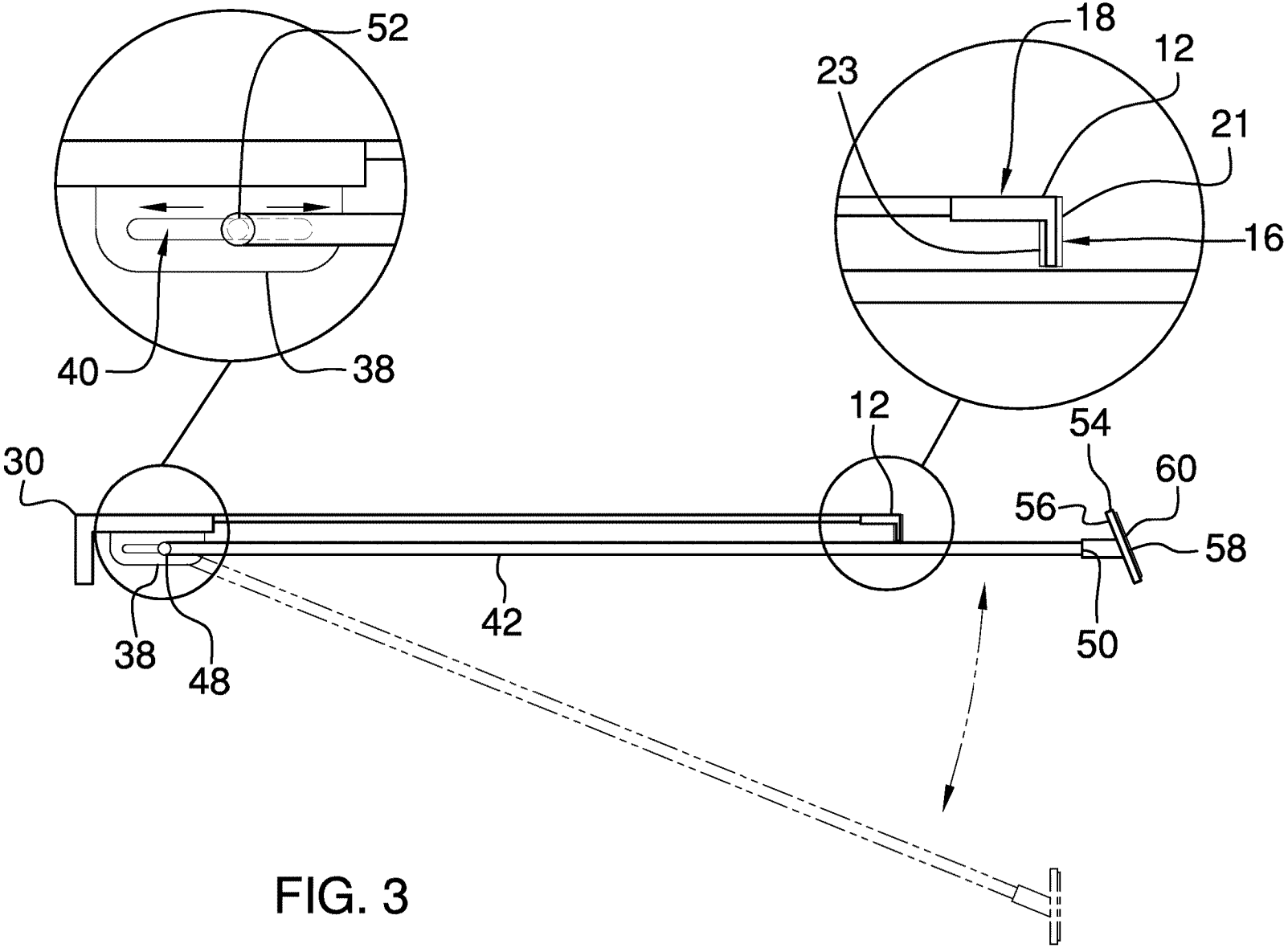
FIG. 3 is a left side view of an embodiment of the disclosure.
Figure 4:
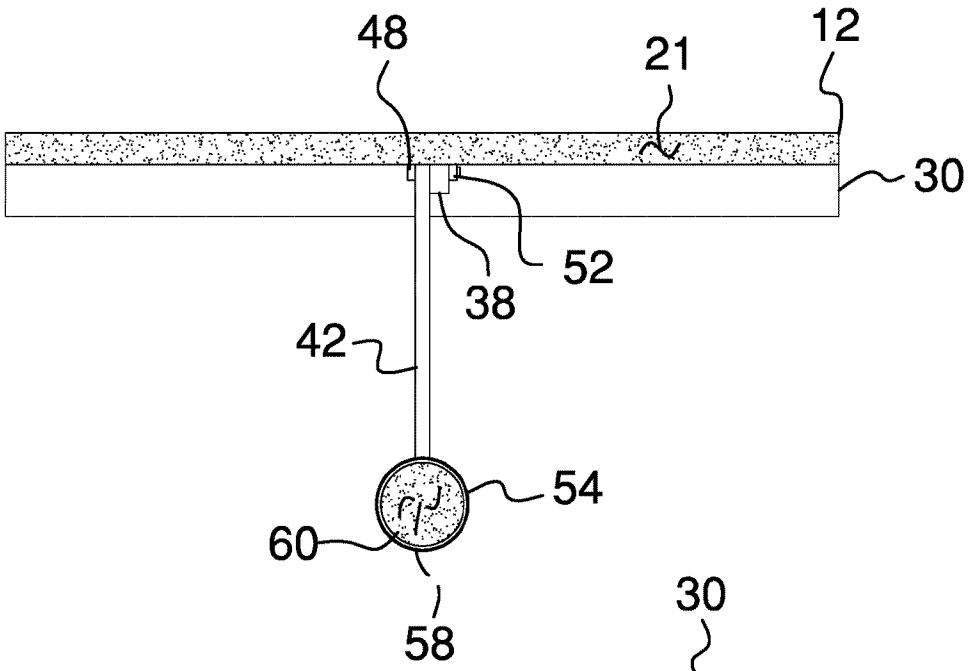
FIG. 4 is a front view of an embodiment of the disclosure.
Figure 5:
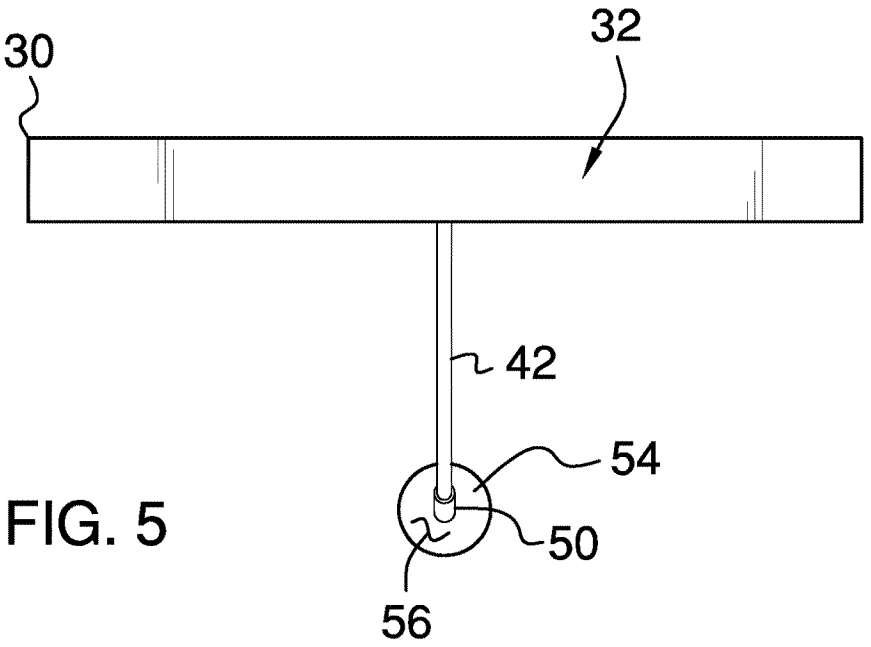
FIG. 5 is a back view of an embodiment of the disclosure.
Figure 6:
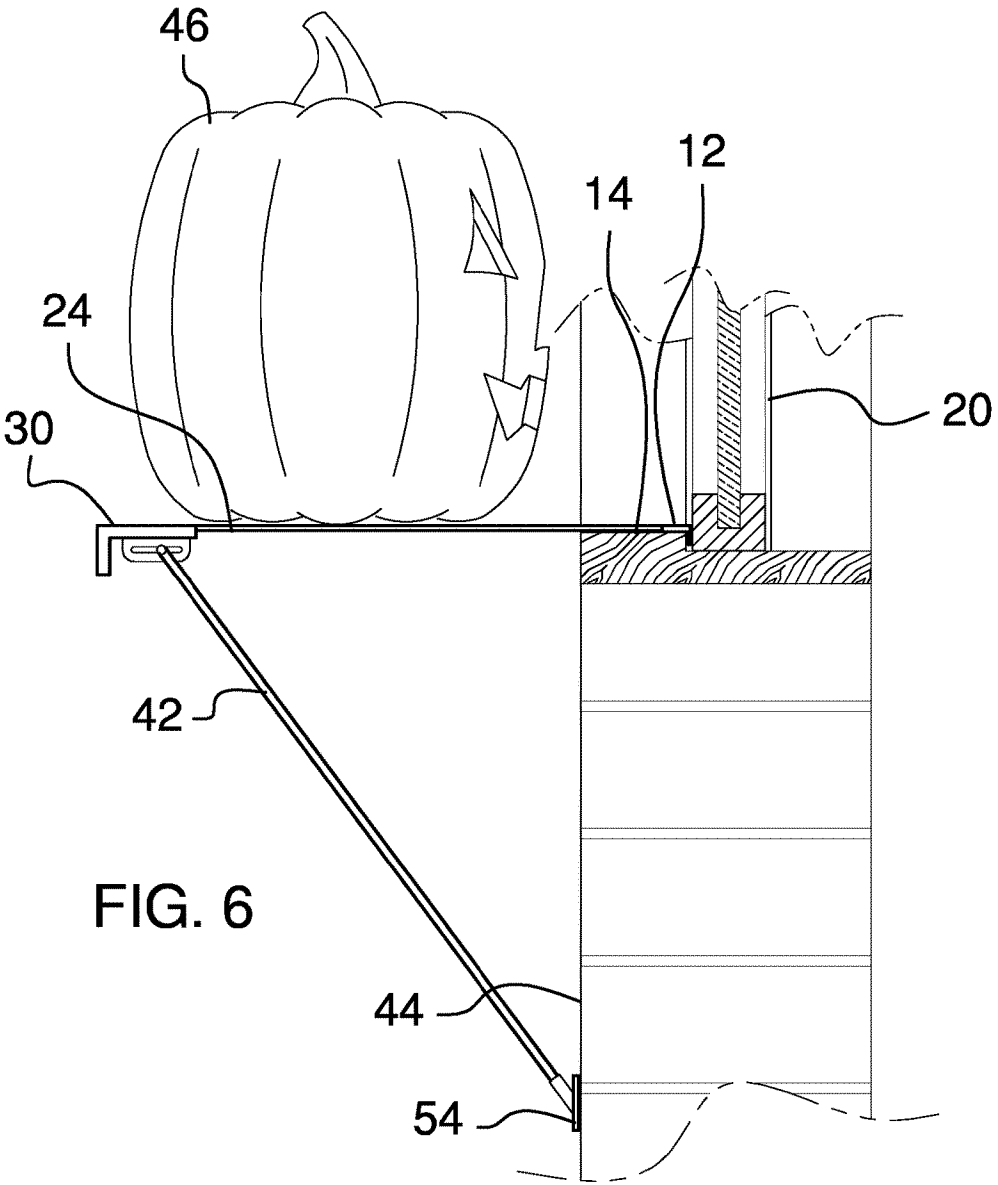
FIG. 6 is a perspective in-use view of an embodiment of the disclosure.

With reference now to the drawings, and in particular to FIGS. 1 through 6 thereof, a new shelf device embodying the principles and concepts of an embodiment of the disclosure and generally designated by the reference numeral 10 will be described.

As best illustrated in FIGS. 1 through 6, the window shelf assembly 10 generally comprises a first bracket 12 that is positionable on a window sill 14. The first bracket 12 has a first portion 16 that forms an angle with respect to a second portion 18. The first portion 16 is positionable between a window 20 and the window sill 14 having the second portion 18 lying on the window sill 14. Additionally, the second portion 18 has a distal edge 22 with respect to the first portion 16. The window 20 may be a window in a building, such as a house or the like. The first portion 16 has a first surface 21 and a second surface 23, and each of the first surface 21 and the second surface 23 comprise an abrasive material for frictionally engaging the window sill 14.

A plurality of bars 24 is each coupled to the first bracket 12. Each of the bars 24 has a first end 26 and a second end 28, and the first end 26 of each of the bars 24 is coupled to the distal edge 22 of the second portion 18 of the first bracket 12. The bars 24 are spaced apart from each other and are distributed along a full length of the second portion 18. Each of the bars 24 may have a length ranging between approximately 8.0 inches and 14.0 inches.

A second bracket 30 is provided and each of the bars 24 is coupled to the second bracket 30 such that the second bracket 30 is spaced from the first bracket 12. The second bracket 30 has a primary portion 32 forming an angle with a secondary portion 34. Additionally, the secondary portion 34 has a distal edge 36 with respect to the primary portion 32. The second end 28 of each of the bars 24 is coupled to the distal edge 36 of the secondary portion 34.

A coupling 38 is coupled to and extends downwardly from the secondary portion 34 of the second bracket 30. The coupling 38 extends along a line extending between the primary portion 32 and the distal edge 36 of the secondary portion 34. The coupling 38 has a slot 40 extending therethrough and the slot 40 is elongated to extend a substantial length of the coupling 38. An arm 42 is movably disposed on the second bracket 30. The arm 42 is abuts a wall 44 in which the window 20 is positioned for supporting the bars 24 on a horizontal plane. In this way the bars 24 define a support surface for displaying an object 46, and the arm 42 has a first end 48 and a second end 50.

A fastener 52 extends through the arm 42 and slidably engages the slot 40 in the coupling 38 for slidably attaching the arm 42 to the coupling 38. The fastener 52 is tightenable to retain the arm 42 at a selected point along the slot 40. The fastener 52 is positioned adjacent to the first end 48 of the arm 42. Additionally, the fastener 52 may comprise a nut and bolt or other type of releasable fastener.

A foot 54 is provided and the foot 54 is coupled to the arm 42 such that the foot 54 abuts the wall 44. The foot 54 has a first surface 56 and a second surface 58, and the first surface 56 is coupled to the second end 28 of the arm 42. The first surface 56 lies on a plane that is oriented at an angle with respect to an axis extending through the first end 48 and the second end 50 of the arm 42. A pad 60 is coupled to the second surface 58 of the foot 54 such that the pad 60 abuts the wall 44. The pad 60 is comprised of a resiliently compressible material to frictionally engage the wall 44.

In use, the first bracket 12 is positioned on the window sill 14 having the first portion 16 being positioned between the window sill 14 and the window 20. The arm 42 is adjusted to abut the wall 44 and to support the bars 24 on a horizontal plane. In this way the bars 24 can support an object 46 for display, such as a holiday ornament or the like, for viewing the object 46 through the window 20. In this way the object 46 can be displayed without requiring a permanent structure to be attached to the window sill 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A window shelf assembly being temporarily attachable to a window for supporting objects to be displayed at the window, said assembly comprising:

a first bracket being positionable on a window sill, wherein said first bracket has a first portion forming an angle with respect to a second portion, said first portion being positionable between a window and the window sill having said second portion lying on the window sill, said second portion having a distal edge with respect to said first portion;

a plurality of bars, each of said bars being coupled to said first bracket, wherein each of said bars has a first end and a second end, said first end of each of said bars being coupled to said distal edge of said second portion of said first bracket, said bars being spaced apart from each other and being distributed along a full length of said second portion;

a second bracket having each of said bars being coupled thereto such that said second bracket is spaced from said first bracket, wherein said second bracket has a primary portion forming an angle with a secondary portion, said secondary portion having a distal edge with respect to said primary portion, said second end of each of said bars being coupled to said distal edge of said secondary portion;

an arm being movably disposed on said second bracket, said arm being abutting a wall in which the window is positioned for supporting said bars on a horizontal plane wherein said bars are configured to define a support surface for displaying an object; and a coupling being coupled to and extending downwardly from said secondary portion of said second bracket, said coupling extending along a line extending between said primary portion and said distal edge of said secondary portion, said coupling having a slot extending therethrough, said slot being elongated to extend a substantial length of said coupling.

2. The assembly according to claim 1, wherein:

said arm has a first end and a second end; and said assembly includes a fastener extending through said arm and slidably engaging said slot in said coupling for slidably attaching said arm to said coupling, said fastener being tightenable to retain said arm at a selected point along said slot, said fastener being positioned adjacent to said first end of said arm.

3. The assembly according to claim 1, wherein:

said arm has a first end and a second end; and a foot being coupled to said arm such that said foot abuts the wall, said foot having a first surface and a second surface, said first surface being coupled to said second end of said arm, said first surface lying on a plane being oriented at an angle with respect to an axis extending through said first end and said second end of said arm.

4. The assembly according to claim 3, further comprising a pad being coupled to said second surface of said foot such that said pad abuts the wall, said pad being comprised of a resiliently compressible material wherein said pad is configured to frictionally engage the wall.

5. A window shelf assembly being temporarily attachable to a window for supporting objects to be displayed at the window, said assembly comprising:

a first bracket being positionable on a window sill, said first bracket having a first portion forming an angle with respect to said second portion, said first portion being positionable between a window and the window sill having said second portion lying on the window sill, said second portion having a distal edge with respect to said first portion;

a plurality of bars, each of said bars being coupled to said first bracket, each of said bars having a first end and a second end, said first end of each of said bars being coupled to said distal edge of said second portion of said first bracket, said bars being spaced apart from each other and being distributed along a full length of said second portion;

a second bracket having each of said bars being coupled thereto such that said second bracket is spaced from said first bracket, said second bracket having a primary portion forming an angle with a secondary portion, said secondary portion having a distal edge with respect to said primary portion, said second end of each of said bars being coupled to said distal edge of said secondary portion;

a coupling being coupled to and extending downwardly from said secondary portion of said second bracket, said coupling extending along a line extending between said primary portion and said distal edge of said secondary portion, said coupling having a slot extending therethrough, said slot being elongated to extend a substantial length of said coupling;

an arm being movably disposed on said second bracket, said arm being abutting a wall in which the window is positioned for supporting said bars on a horizontal plane wherein said bars are configured to define a support surface for displaying an object, said arm having a first end and a second end;

a fastener extending through said arm and slidably engaging said slot in said coupling for slidably attaching said arm to said coupling, said fastener being tightenable to retain said arm at a selected point along said slot, said fastener being positioned adjacent to said first end of said arm;

a foot being coupled to said arm such that said foot abuts the wall, said foot having a first surface and a second surface, said first surface being coupled to said second end of said arm, said first surface lying on a plane being oriented at an angle with respect to an axis extending through said first end and said second end of said arm; and a pad being coupled to said second surface of said foot such that said pad abuts the wall, said pad being comprised of a resiliently compressible material wherein said pad is configured to frictionally engage the wall.

* * * * *